US007156601B2

(12) United States Patent
Cobene, II

(10) Patent No.: US 7,156,601 B2
(45) Date of Patent: Jan. 2, 2007

(54) SYSTEMS AND METHODS OF BINDING A PLURALITY OF TEXT BODIES

(75) Inventor: Robert L. Cobene, II, Santa Clara, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 344 days.

(21) Appl. No.: 10/448,034

(22) Filed: May 30, 2003

(65) Prior Publication Data

US 2004/0240966 A1 Dec. 2, 2004

(51) Int. Cl.
*B42C 9/00* (2006.01)

(52) U.S. Cl. ..... 412/8; 412/6; 412/33; 412/37; 412/900; 412/902

(58) Field of Classification Search ..... 412/33–34, 412/37, 900, 902, 6, 8; 156/908; 118/679
See application file for complete search history.

(56) References Cited

U.S. PATENT DOCUMENTS

| | | | | |
|---|---|---|---|---|
| 4,077,078 | A | 3/1978 | Snellman et al. | |
| 4,149,289 | A * | 4/1979 | Sahlin | 412/1 |
| 4,150,453 | A | 4/1979 | Vaughn | |
| 4,911,475 | A | 3/1990 | Lerman | |
| 4,925,354 | A | 5/1990 | Cote | |
| 5,044,857 | A | 9/1991 | Crudo | |
| 5,052,872 | A | 10/1991 | Hunder et al. | |
| 5,078,425 | A | 1/1992 | Crudo | |
| 5,114,292 | A * | 5/1992 | Geiser | 412/11 |
| 5,193,962 | A | 3/1993 | Parker et al. | |
| 5,271,794 | A | 12/1993 | Jarrell et al. | |
| 5,346,350 | A | 9/1994 | Luhman et al. | |
| 5,536,044 | A | 7/1996 | Luhman et al. | |
| 5,569,011 | A * | 10/1996 | Yamaguchi et al. | 412/9 |
| 5,569,012 | A * | 10/1996 | Kosasa et al. | 412/33 |
| 5,702,220 | A | 12/1997 | Combs | |
| 5,833,423 | A * | 11/1998 | Yamaguchi et al. | 412/8 |
| 5,899,649 | A * | 5/1999 | Kohtani et al. | 412/11 |
| 6,000,894 | A * | 12/1999 | Suzuki et al. | 412/11 |
| 6,024,525 | A | 2/2000 | Yamanaka | |
| 6,193,458 | B1 | 2/2001 | Marsh | |
| 6,440,254 | B1 | 8/2002 | Rich et al. | |
| 6,619,900 | B1 * | 9/2003 | Cobene et al. | 412/1 |
| 6,652,210 | B1 * | 11/2003 | Yeaple | 412/37 |
| 2002/0106264 | A1 | 8/2002 | Cobene, II et al. | |
| 2002/0119029 | A1 | 8/2002 | Cobene et al. | |
| 2002/0168248 | A1 | 11/2002 | Ertel et al. | |

FOREIGN PATENT DOCUMENTS

| | | |
|---|---|---|
| WO | WO99/38707 | 8/1999 |
| WO | WO02/090122 | 5/2002 |

* cited by examiner

*Primary Examiner*—Monica Carter
*Assistant Examiner*—Eric A. Gates

(57) ABSTRACT

A binding system for binding a plurality of text bodies in a continuous manner includes an adhesive strip applier, a heating device, and a cooling device. A transporting system transports a plurality of text bodies to the adhesive strip applier which applies a preformed adhesive strip to the moving text body. The heating device heats the adhesive strip and melts the adhesive strip into contact with the text body and the cooling device cools the adhesive to form a bound text body.

36 Claims, 4 Drawing Sheets

SYSTEMS AND METHODS OF BINDING A PLURALITY OF TEXT BODIES

DESCRIPTION OF THE RELATED ART

Today, a variety of different bookbinding systems can deliver professional bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinges areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text body spine. The covers of hardcover books and some soft cover "lay flat" books, on the other hand, typically are attached to the side hinge areas of the text body and are not attached to the text body spines (i.e., the spines are "floating").

Many different systems have been proposed for applying adhesive to a text body spine to bind the text body sheets together.

For example, U.S. Pat. No. 6,024,525 describes a bookbinder that includes a tape heating apparatus with a main heater and a pair of side heaters. The main heater is configured to heat the entire length of a hot melt adhesive tape. After the spine of a text body is pressed against the preheated hot melt adhesive tape, the pair of side heaters press the overhanging sides of the adhesive tape against the text body to complete the binding of the sheets into a bound text body.

U.S. Pat. No. 5,346,350 discloses an apparatus for binding sheets that includes an aligning plate that aligns the sheets at the spine edge, and two clamping plates that hold the sheets during binding. A heating platen heats and melts a backless solid hot melt adhesive that is placed along the sheet edges. The hot melt adhesive binds the sheets together at the spinal area.

U.S. Pat. No. 4,925,354 discloses an apparatus for applying adhesive to books which extrudes lengths of adhesive from a high pressure glue gun onto a roller. The books are conveyed into contact with the adhesive on the roller and the adhesive is transferred from the roller to the book. A scraper removes excess adhesive from the roller and the removed adhesive is collected in a reservoir for reuse.

The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers move forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

U.S. Pat. No. 4,911,475 discloses a bookbinding construction in which sheets are bound together into a book block by two or more spaced-apart transverse segments of adhesive. The front section of a cover is attached to the first page of the book block and the back section of the cover is secured to the last page of the book block. Upon opening the book or turning a page, glue-free portions of the spine edge of the open page flex or bow outward over the facing page in a wedging manner or interfering fit. According to the '475 patent, this wedging action against the opposite page resists the tendency of the book to spring closed and forces the pages of the book to lie flat.

U.S. Pat. No. 5,271,794 discloses an adhesive applicator that is configured to spread coat an adhesive onto the spine and side edges of a text body to bind the text body sheets and a cover into a perfectly bound book with an attached spine. The adhesive applicator includes a book spine coating nozzle with adjustable side sealing jaws for adjusting the nozzle width for different book thicknesses and separate side glue outlets for depositing glue on the book sides. Glue flow control valves are disposed between the spine coating nozzle and the side glue outlets so the glue deposited on the book sides may be selectively and independently cut off or controlled.

Still other bookbinding systems have been proposed.

SUMMARY

Systems and methods are described for binding a plurality of text bodies in a continuous manner.

According to one aspect, a system of binding a plurality of text bodies, comprises an adhesive strip applier configured to apply a preformed adhesive strip to a spine of a moving text body, a heating device arranged to heat the adhesive strip applied to the spine of the text body and melt the adhesive strip into contact with the moving text body, and a cooling device arranged to cool the adhesive on the moving text body.

According to another aspect, a system of binding a plurality of text bodies, comprises an adhesive strip applier configured to apply preformed adhesive strips comprising solid adhesive to spines of a plurality of moving text bodies, an activating device arranged to liquify the adhesive strips on the plurality of moving text bodies, and a text body transporting system configured to transport the text bodies through the adhesive strip applier and the activating device at a substantially constant velocity.

According to a further aspect, a method of binding sheets into a bound text body, comprises applying a preformed adhesive strip to a moving text body, heating the adhesive strip on the moving text body to melt adhesive from the strip into contact with the moving text body, and cooling the adhesive on the moving text body.

According to an addition aspect, a system for binding a plurality of text bodies, comprises transfer means for transferring a preformed adhesive strip to a spine of a moving text body, heating means for melting the adhesive strip into contact with the moving text body, and cooling means for cooling the adhesive on the moving text body to form a bound text body.

BRIEF DESCRIPTION OF THE DRAWING FIGURES

Exemplary embodiments are illustrated in the accompanying drawings, in which like elements bear like reference numerals, and wherein.

DETAILED DESCRIPTION

Figure 1:
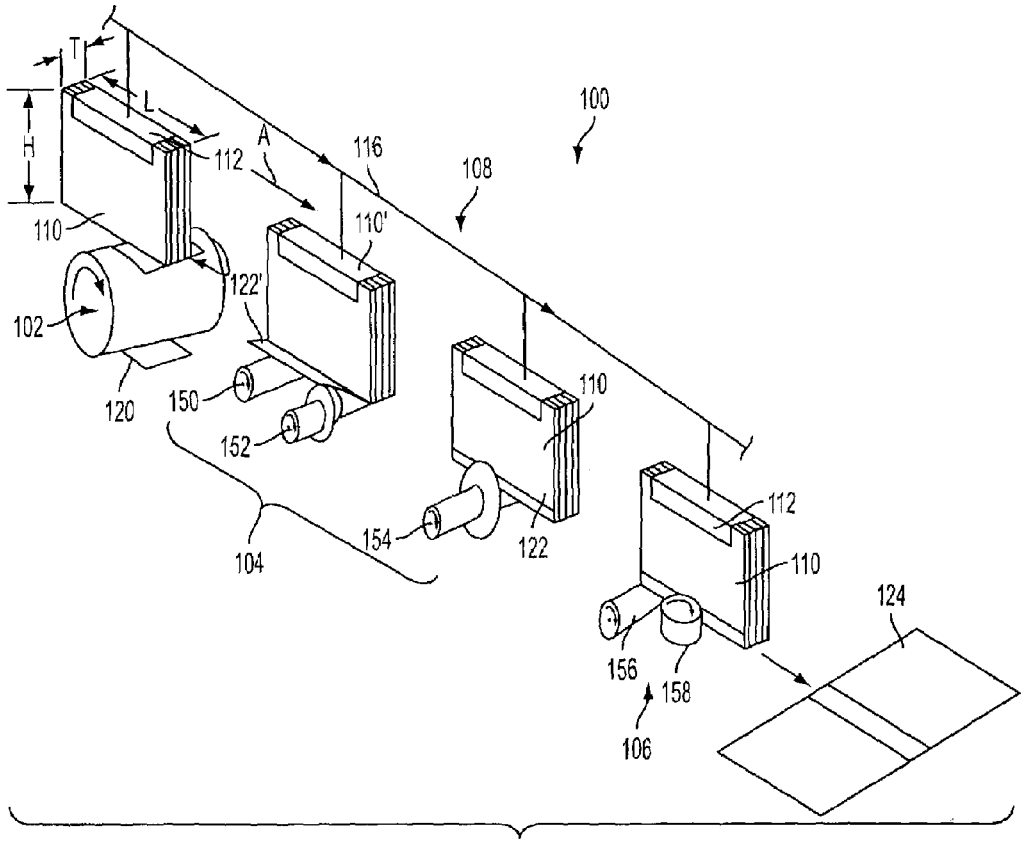
FIG. 1 is a diagrammatic perspective view of a bookbinding system.
Figure 2A:
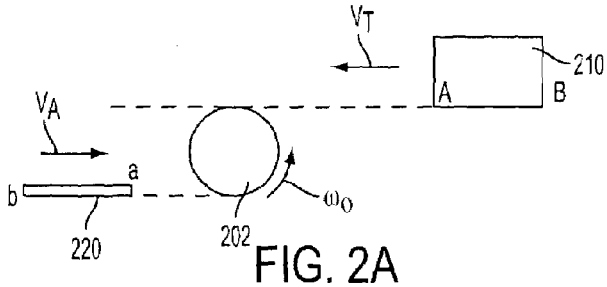
FIGS. 2A–2D are diagrammatic side views of a process of applying an adhesive strip with an adhesive strip applier.
Figure 2B:
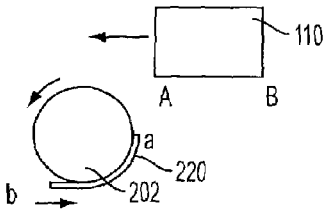
Figure 2C:
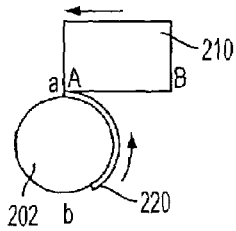
Figure 2D:
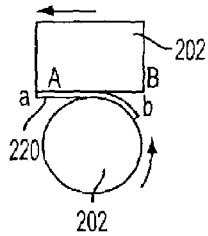

FIG. 1 illustrates one example of a system of binding a plurality of text bodies in a continuous manner. The system 100 includes an adhesive strip applier 102, a heating device 104, and a cooling device 106 for binding a plurality of text bodies 110 which are transported by a transporting system 108.

The text bodies 110 in the embodiment of FIG. 1 include a plurality of sheets forming a stack having a height H, a length L, and a thickness T. The sheets are clamped together as the text body 110 by one or more clamps 112 of the transporting system 108. The clamps 112 are moved by a conveyor system 116 along a path which transports the text bodies through the binding system 100 which applies adhesive to the spine of the text body. The conveyor system 116 and clamps 112 may be any of those systems which are known to those in paper handling, such as those described in U.S. Pat. No. 4,925,354 which is incorporated herein by reference.

According to one example, the conveyor system 116 transports the text bodies 110 in the direction of the arrow A at a substantially constant velocity $V_0$ through the binding system 100. Accordingly, multiple text bodies 110 may be bound in a continuous manner to improve the throughput of a bookbinding system.

In one sheet binding embodiment, text body 110 may be bound with a solid hot melt adhesive as follows. An adhesive dispensing system (not shown) disposes a preformed solid hot melt adhesive strip 120 onto the adhesive strip applier 102. The adhesive strip 120 is delivered to the edge of the text body 110 by the adhesive strip applier 102. A spot heater can tack the dispensed adhesive strip 120 to the text body spine. An adhesive dispensing system can cut the adhesive to a desired length and/or width or the adhesive strip 120 can be loaded precut into the bookbinding system. One example of an adhesive dispersing system is described in WO 02/090122 published Nov. 14, 2002 to John P. Ertel and entitled "DISPENSING SOLID SHEET ADHESIVE IN A BOOKBINDING SYSTEM," which is incorporated herein by reference in its entirety.

The adhesive heating device 104 heats the preformed solid hot melt adhesive strip 120 to a temperature at or above the melting temperature of the adhesive. The melted liquid adhesive conforms to the exposed surface features of the spinal area of the text body 110 and flows into spaces between the ends of sheets. The heating device 104 can also include a forming device, such as forming rollers 150, 152, 154 or pinch rollers which form the melted adhesive to a text body spine 122. Adhesive cooling device 106 cools the formed adhesive until the adhesive re-solidifies to bind the text body sheets into a bound text body.

Although a heating device 104 has been described, other activating devices may also be used depending on the adhesive employed. For example, light cured adhesives may be used with an illuminating activating device.

After formed hot melt adhesive has re-solidified to bind the text body sheets into a bound text body, the bound text body may be subjected to one or more additional processing steps. For example, a cover 124 may be attached to the bound text body as described in co-pending U.S. patent application Ser. No. 09/721,549, filed Nov. 24, 2000 by Robert L. Cobene et al., and entitled "SYSTEMS AND METHODS OF ATTACHING A COVER TO A TEXT BODY," U.S. patent application publication number US 2002/0119029, published Aug. 29, 2002 to Robert L. Cobene et al., and entitled "SYSTEMS AND METHODS OF REGISTERING A COVER WITH RESPECT TO A TEXT BODY," and U.S. patent application Ser. No. 10/231,037, filed Aug. 30, 2002 by Robert L. Cobene et al., and entitled "AN APPARATUS AND METHOD FOR ATTACHING A COVER TO AN ASSEMBLY OF SHEETS," which are incorporated hereby by reference in their entirety.

According to the example of FIG. 1, the hot melt adhesive strips 120 can be preformed having a length which is precisely equal to the length L of the text body. The strips can have a width which is greater than the thickness T of the text body to allow the adhesive to be wrapped around the sides of the book spine. The adhesive strip applier 102 functions to pick up the adhesive strip 120 and bring the adhesive strip into contact with the spine of the text body 110 with the leading edge of the adhesive strip precisely aligned with the leading edge of the text body. The adhesive strip 120 is applied to the text body 110 while the text body continues to move through the bookbinding system 100 by the conveyor 116.

A variety of different adhesive compositions may be used to bind the text body sheets, including a conventional paper-backed hot melt sheet adhesive that may be dispensed from a roll and may be obtained from Minnesota Mining and Manufacturing Company (3M), of St. Paul, Minn., United States. The size of the adhesive strips needed can be calculated from the size, number, and thickness of the sheets in the text body. The size and shape of the adhesive strip can also be measured from the clamped text body. One example of an adhesive dispenser which trims adhesive strips to a desired size is described in U.S. patent application publication number U.S. 2002/0168248, published Nov. 14, 2002 to John P. Ertel et al., and entitled "DISPENSING ADHESIVE IN A BOOKBINDING SYSTEM."

In FIG. 1, the text body with the attached adhesive strip 120, which may be tacked into place or otherwise adhered to the clamped text body, then proceeds to the heating device 104 which heats and forms the adhesive strip to form the spine of the text body. The heating device 104 in the example of FIG. 1 includes three heated forming rollers 150, 152, 154 which progressively form the sides of the adhesive strip 120 to the sides of the text body while heating and melting the adhesive of the adhesive strip to cause the adhesive to flow into spaces between the ends of the sheets forming the spine of the text body. FIG. 1 illustrates a text body 110' which shows the adhesive strip 122' being formed or folded up around the sides of the text body by enlarged flange portions of the second roller 152. Although three heated forming rollers 150, 152, 154 are illustrated with progressively more upright flange portions for forming, other numbers and configurations of forming rollers and members can be used.

The text body 110 proceeds from the heating device 104 to the cooling device 106. In the example of FIG. 1, the cooling device 106 includes a first roller 156 and a pair of second rollers 158 which are arranged to contact the adhesive of the spine providing a heat sink which cools the adhesive by conduction and convection to form a bound text body. In one embodiment the heating rollers and cooling rollers can be placed close together such that the heating and cooling processes are performed on different portions of the same text body at the same time.

FIGS. 2A–2D illustrate the application of the adhesive strip 220 to the text body 210 by the adhesive strip applier 202 in the form of a transfer roller. FIGS. 2A–2D illustrate how the rotation of the adhesive strip applier 202 and the conveying of the text body 210 are coordinated such that a leading edge a of the adhesive strip is precisely aligned with a leading edge A of the text body and trailing edge b of the adhesive strip is precisely aligned with a trailing edge B of the text body. This involves coordination of the velocity $V_T$ of the text body, the velocity $V_A$ of the adhesive strip 220, and the angular velocity $\omega_O$ of the transfer roller 202.

In the embodiments illustrated in FIGS. 1 and 2A–2D, the text body is conveyed in a direction which is substantially parallel to a length of the spine of the text body or parallel to the length dimension L of the text body. In this arrangement, the adhesive strip applier 102, 202, heating device 104, and cooling device 106, can be arranged as close together as possible so that more than one of these devices is operating on the same text body at the same time. Further, the individual text bodies 110 may be mounted on the conveyor 116 by the clamps 112 as close together as practical to achieve efficient and continuous binding of the text bodies.

Figure 3A:
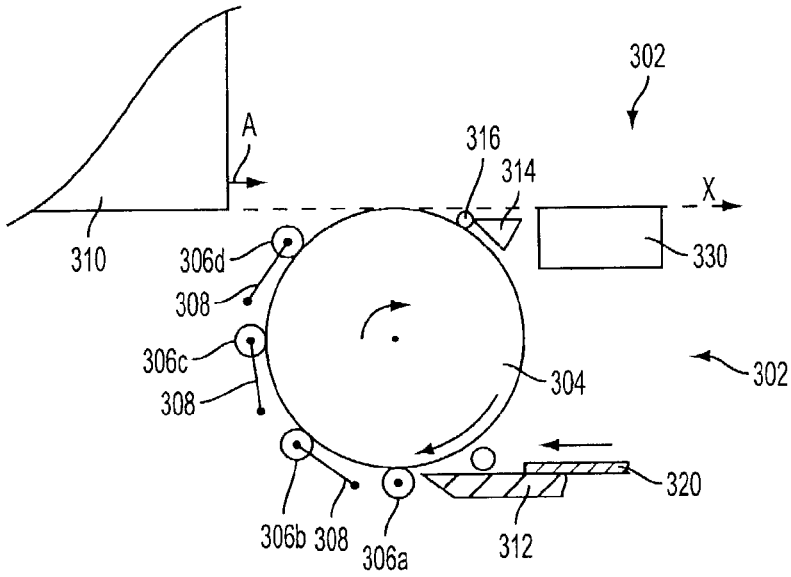
FIG. 3A is a diagrammatic side view of an adhesive strip applier having a transfer roller with pinch wheels.
Figure 3B:
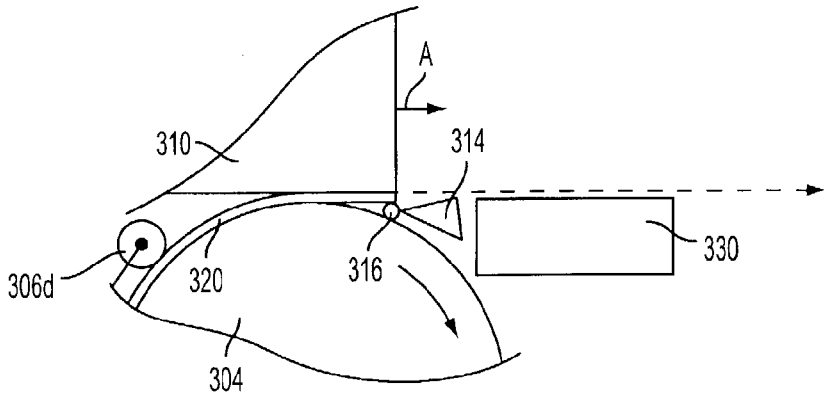
FIG. 3B is an enlarged side view of a portion of the adhesive strip applier of FIG. 3A.

FIGS. 3A, 3B, 4A, 4B, and 5 illustrate three examples of adhesive strip appliers employing transfer rollers. In the example of FIGS. 3A and 3B an adhesive strip applier 302 includes a transfer roller 304, a plurality of pinch rollers 306*a*–306*d*, a plurality of guides 308, a strip delivery system 312, and a strip separating guide 314. According to the example of FIGS. 3A and 3B an adhesive strip 320 is delivered by the strip delivery system 312 to the nip of the first pinch roller 306*a* and the strip is held on the transfer roller by the successive pinch rollers 306*b*, 306*c*, and 306*d* and the associated guides 308. The text body 310 is transported in the direction of the arrow A with the spine traveling along the line X such that the text body spine comes into contact with the adhesive strip 320. The strip separating guide 314 separates the adhesive strip 320 from the transfer roller 304 upon delivery of the strip to the text body. After delivery of the adhesive strip 320 to the text body 310 by the transfer roller 304 the heating device 330 melts the adhesive strip and insures contact between the adhesive and the text body. As shown in FIG. 3B, the speed and position of the text body 310 and rotation of the transfer roller 304 are precisely controlled to precisely align the leading edges of the text body and adhesive strip upon application of the adhesive strip to the text body. The strip separating guide 314 can include a counter rotating roller 316 for separating the adhesive strip 320 from the transfer roller 304.

Figure 4A:
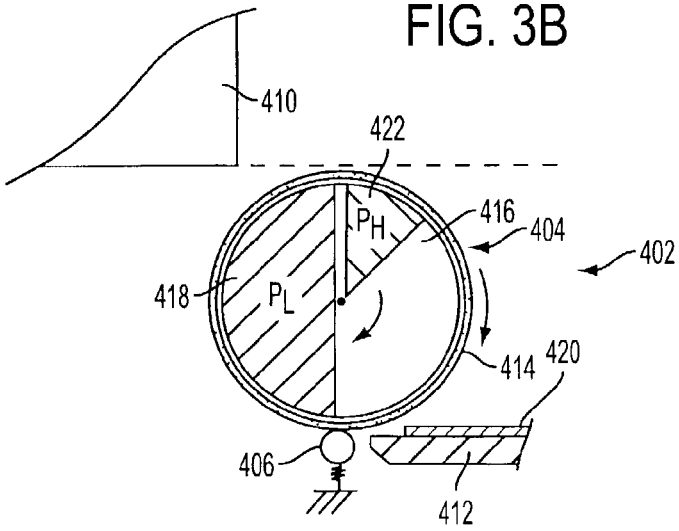
FIG. 4A is a diagrammatic side view of an adhesive strip applier having a transfer roller with a vacuum surface.
Figure 4B:
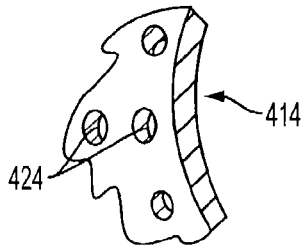
FIG. 4B is a diagrammatic perspective view of a portion of the transfer roller of FIG. 4A.

FIGS. 4A and 4B illustrate a further example of an adhesive strip applier 402 including a transfer roller 404, a pinch roller 406, and a strip delivery system 412. The transfer roller 404 includes a rotatable outer roller shell 414 and a fixed inner pressure control member 416. The fixed inner member 416 is a cylindrical member having a section 418 at a low pressure $P_L$ and a section 422 at a high pressure $P_H$. The low pressure and high pressure areas 418, 422 are connected to a pressure control system (not shown) for maintaining these areas at the desired pressures by known methods such as vacuum pumps, blowers, and the like.

FIG. 4B shows an enlarged portion of the outer rotatable roller 414 having a plurality of perforations 424 allowing air to pass through the outer roller to control adherence of the adhesive strips 420 to the transfer roller.

In operation, the adhesive strip 420 enters in a nip between the pinch roller 406 and the transfer roller 404 and is attracted to the transfer roller surface due to the low pressure area 418. The low pressure area has a pressure $P_L$ lower than atmospheric which causes the adhesive strip 420 to be retained on the perforated surface of the outer rotatable roller 414. As the adhesive strip is transported by rotation of the outer roller 414 to the area adjacent the high pressure area 422, the high pressure $P_H$ (higher than atmospheric) within the transfer roller forces the adhesive strip 420 away from the transfer roller and onto the text body. The adhesive strip 420 is subsequently heated by the heating device 330 to melt the adhesive onto the text body 410.

Figure 5:
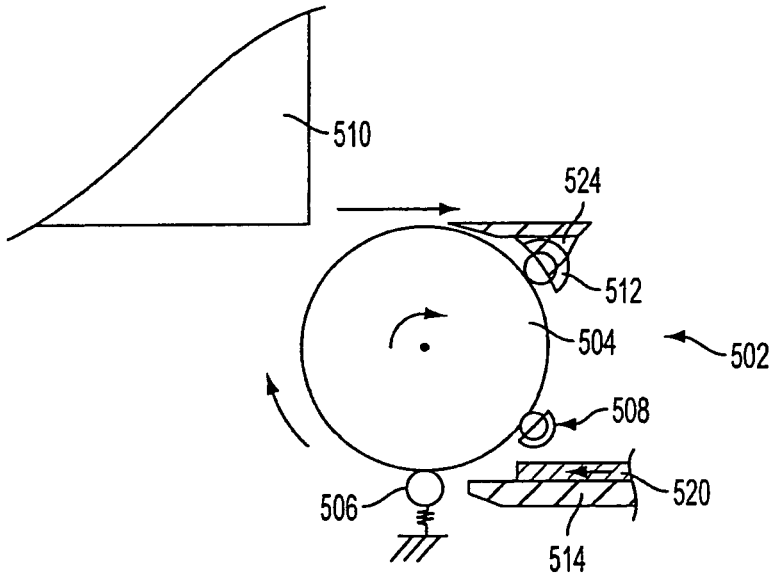
FIG. 5 is a diagrammatic side view of an adhesive strip applier with a transfer roller having an electrostatic surface.
Figure 6A:
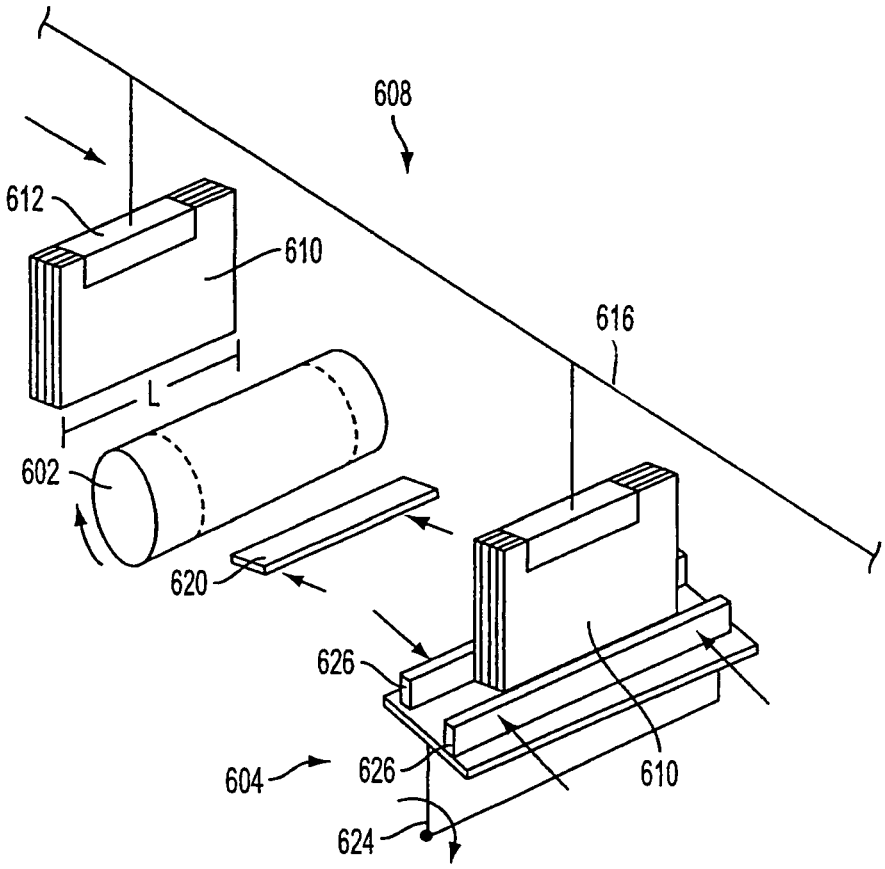
FIG. 6 is a diagrammatic perspective view of a bookbinding system having text bodies transported perpendicular to their spines.
Figure 6B:
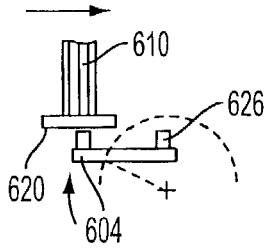
Figure 6C:
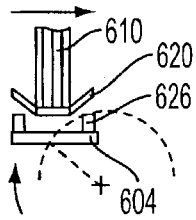
Figure 6D:
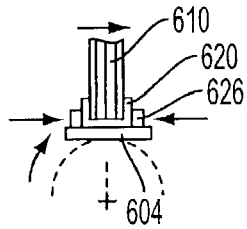
Figure 6E:
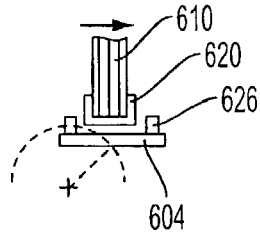

FIG. 5 illustrates a further example of a adhesive strip applier 502 including a transfer roller 504, a pinch roller 506, a charge roller 508 and a discharge roller 512, and a strip delivery system 514. In the example of FIG. 5, an adhesive strip 520 enters the nip between the transfer roller 504 and the pinch roller 506, the adhesive strip 520 as delivered to the transfer roller 504 has a neutral charge which may be ensured by the strip delivery system 514 such as by a discharge roller. The transfer roller 504 has a surface charged to some voltage so that the nonconducting adhesive strip 520 is held in place on the transfer roller for delivery to the text body 510. In one example, the transfer roller charge is 1 kV or less. The adhesive strip 520 is held on the transfer roller 504 by the electrostatic forces which are greater than the forces applied to the adhesive strip by both gravity and centrifugal forces. The discharge roller 512 and associated discharge blade 524 dissipate any non-zero charge on the transfer roller 504 at a location just past a contact point between the text body 510 and the transfer roller. The electrostatic charge of the transfer roller 504 is provided by the charge roller 508 or another known charging device.

FIGS. 6A–6E illustrate another example of the invention in which the text bodies 610 are conveyed by a transporting system 608 including a conveyor 616 and a clamp 612 in a direction which is substantially perpendicular to a length L of the spine of the text body. In this embodiment, the adhesive strip 620 is applied by an adhesive strip applier 602 with the leading and trailing edges free of the text body 610 so that they can be wrapped around the sides of the text body. In this instance, precise alignment of the leading and trailing edges of the adhesive strip 620 with the text body 610 is unnecessary and precise alignment of the ends of the text body with the ends of the adhesive strip can be provided.

As shown in FIGS. 6A–6E, a heating and forming device 604 includes moving side walls 626 which engage and fold the free side edges of the adhesive strip 620. The heating and forming device 604 is moved in an arc shaped path to operate on the moving text body 610 by a rotating arm 624 supporting the heating and forming device and the moving side walls 626. The rotating arm 626 moves the heating and forming device 604 into contact with the spine of the text body 610 with the adhesive strip 620 held in place on the spine. The heating and forming device 604 both heats the adhesive and forms the sides of the adhesive strip 620 causing them to fold around the sides of the text body.

In sum, the above-described embodiments incorporate novel systems and methods for binding a text body in a manner that may improve the performance and cost-effectiveness of desktop and office on-demand bookbinding systems.

Figure 7:
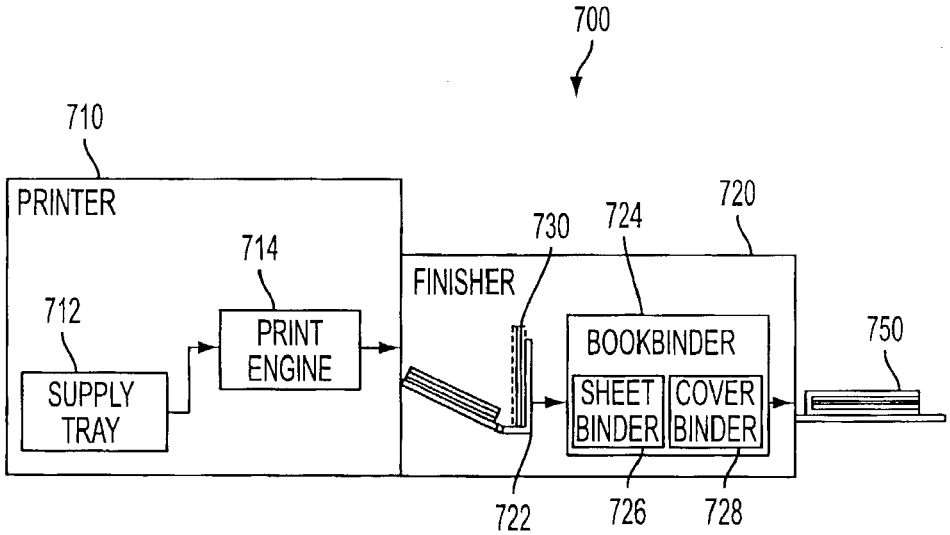
FIG. 7 is a diagrammatic side view of a bookbinder incorporating the bookbinding system.

Referring to FIG. 7, in one embodiment, a bookbinding system 700 includes a printer 710 and a finisher 720. Bookbinding system 700 may be implemented as a desk top or office book making system designed to satisfy on-demand bookbinding needs. Printer 710 may be a conventional printer that includes a supply tray 712 that is configured to hold a plurality of sheets (e.g., paper sheets) and a print engine 714 that is configured to apply markings onto the sheets received from the supply tray 712. The finisher 720 includes a sheet collector 722 and a bookbinder 724. Bookbinder 724 includes a sheet binder 726 that is configured to bind the text body sheets to one another and a cover binder 728 that is configured to attach a cover to the bound text body. In operation, sheets are fed from supply tray 712 to print engine 714, which prints text, pictures, graphics, images and other patterns onto the sheets. The printed sheets 730 are fed to sheet collector 722 which collects and aligns the sheets into a text body with an exposed spine bound by two exposed side hinge areas. The text body is conveyed to the bookbinder 724. The sheet binder 726 binds the sheets of the text body, such as by the systems shown in FIGS. 1 and 6A, and the cover binder 728 attaches a cover to the bound text body to produce a bound book 750 with a floating or attached spine.

Although in the above-described embodiments the preformed hot melt adhesive is heated by a contact heater, other methods of heating the adhesive may be used. In some embodiments, a radiant heater (e.g., a tungsten core quartz lamp) may be used to melt the hot melt adhesive. In another embodiment the transfer roller may also perform the heating function.

While the invention has been described in detail with reference to the preferred embodiments thereof, it will be apparent to one skilled in the art that various changes and modifications can be made and equivalents employed, without departing from the present invention.

What is claimed is:

1. A system of binding a plurality of text bodies, comprising:

an adhesive strip applier configured to apply a preformed adhesive strip, in its entirety, to a spine of a continuously moving text body;

a heating device arranged to heat the adhesive strip applied to the spine of the text body and melt the adhesive strip into contact with the moving text body; and a cooling device arranged to cool the adhesive on the moving text body.

2. The system of claim 1, comprising a text body transporting system including a clamping mechanism configured to clamp and transport the text body to the adhesive strip applier, the heating device, and the cooling device.

3. The system of claim 2, wherein the text body transporting system transports the text body in a direction substantially parallel to a length of a spine of the text body.

4. The system of claim 2, wherein the text body transporting system transports the text body in a direction substantially perpendicular to a length of a spine of the text body.

5. The system of claim 1, wherein the adhesive strip applier includes a transfer roller.

6. The system of claim 5, wherein the transfer roller includes the heating device.

7. The system of claim 1, comprising a forming device configured to fold down edges of the melted adhesive strip into contact with the moving text body.

8. The system of claim 1, wherein the adhesive strip applier comprises a transfer roller and pinch wheels.

9. The system of claim 1, wherein the adhesive strip applier comprises a transfer roller with a vacuum surface.

10. The system of claim 1, wherein the adhesive strip applier, heating device, and cooling device are arranged to operate on a text body which is moving at a constant velocity.

11. The system of claim 1, wherein the adhesive strip applier is configured to pick up a preformed adhesive strip comprising a solid hot melt adhesive in an unactivated state.

12. A system of binding a plurality of text bodies, comprising:

an adhesive strip applier configured to apply a preformed adhesive strip to a spine of a moving text body;

a heating device arranged to heat the adhesive strip applied to the spine of the text body and melt the adhesive strip into contact with the moving text body; and a cooling device arranged to cool the adhesive on the moving text body, wherein the adhesive strip applier comprises a transfer roller with an electrostatic surface.

13. A system of binding a plurality of text bodies, comprising:

an adhesive strip applier configured to apply a preformed adhesive strip to a spine of a moving text body;

a heating device arranged to heat the adhesive strip applied to the spine of the text body and melt the adhesive strip into contact with the moving text body; and a cooling device arranged to cool the adhesive on the moving text body, wherein the system operates continuously with the cooling device cooling the adhesive on a first text body while the adhesive strip applier applies a preformed adhesive strip to a second text body.

14. A system of binding a plurality of text bodies, comprising:

an adhesive strip applier configured to apply, in its entirety, a preformed adhesive strip comprising solid adhesive to a spine of each of a plurality of moving text bodies;

an activating device arranged to liquify the adhesive strips on the plurality of moving text bodies; and a text body transporting system configured to transport the text bodies through the adhesive strip applier and the activating device at a substantially constant velocity.

15. The system of claim 14, wherein the adhesive strip applier includes a transfer roller.

16. The system of claim 15, wherein the transfer roller includes the heating device.

17. The system of claim 14, comprising a forming device configured to fold down edges of the adhesive strips into contact with the moving text bodies.

18. The system of claim 14, wherein the adhesive strip applier comprises a transfer roller and pinch wheels.

19. The system of claim 14, wherein the adhesive strip applier comprises a transfer roller with a vacuum surface.

20. The system of claim 14, wherein the adhesive strip applier comprises a transfer roller with an electrostatic surface.

21. The system of claim 14, wherein the activating device comprises a heating device configured to melt the solid adhesive.

22. A method of binding sheets into a bound text body, comprising:

applying a preformed adhesive strip, in its entirety, to a continuously moving text body;

heating the adhesive strip on the moving text body to melt adhesive from the strip into contact with the moving text body; and cooling the adhesive on the continuously moving text body.

23. The method of claim 22, wherein the applied adhesive is tacked onto the moving text body in the applying step and is melted in the heating step.

24. The method of claim 22, wherein preformed adhesive strip comprises an adhesive in a solid state, the adhesive is melted to a liquid state in the heating step, and the adhesive is cooled to a solid state in the cooling step.

25. The method of claim 22, comprising a step of forming the preformed adhesive strip to a precise length of the text body.

26. The method of claim 22, comprising a step of folding down edges of the melted adhesive strip into contact with the moving text body prior to cooling.

27. The method of claim 22, wherein the adhesive strip is applied by a transfer roller and is retained on the transfer roller prior to application by pinch wheels.

28. The method of claim 22, wherein the adhesive strip is applied by a transfer roller and is retained on the transfer roller prior to application with a vacuum surface of the transfer roller.

29. The method of claim 22, wherein the adhesive strip is applied by a transfer roller and is retained on the transfer roller prior to application with an electrostatic surface of the transfer roller.

30. A system for binding a plurality of text bodies, comprising:

transfer means for transferring a preformed adhesive strip, in its entirety, to a spine of a continuously moving text body;

heating means for melting the adhesive strip into contact with the moving text body; and cooling means for cooling the adhesive on the continuously moving text body to form a bound text body.

31. The system of claim 30, comprising means for transporting the text body in a continuous manner through the transfer means, heating means, and cooling means.

32. The system of claim 31, wherein the means for transporting transports the text body in a direction substantially parallel to a length of a spine of the text body.

33. The system of claim 31, wherein the means for transporting transports the text body in a direction substantially perpendicular to a length of a spine of the text body.

34. The system of claim 30, comprising a forming means for folding edges of the melted adhesive strip into contact with the moving text body.

35. The system of claim 30, wherein the transfer means, heating means, and cooling means operate on a text body which is moving at a constant velocity.

36. The system of claim 35, wherein the transfer means delivers a preformed adhesive strip in a solid state to the moving text body and tacks the adhesive strip in place.

* * * * *